US009895883B1

(12) United States Patent
Seto et al.

(10) Patent No.: US 9,895,883 B1
(45) Date of Patent: Feb. 20, 2018

(54) DRIVE WAVEFORM GENERATION DEVICE AND IMAGE FORMING APPARATUS

(71) Applicant: FUJI XEROX CO., LTD., Tokyo (JP)

(72) Inventors: Shinji Seto, Kanagawa (JP); Takashi Yagi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 15/460,572

(22) Filed: Mar. 16, 2017

(30) Foreign Application Priority Data

Sep. 5, 2016 (JP) ..... 2016-172974

(51) Int. Cl.
*B41J 2/045* (2006.01)

(52) U.S. Cl.
CPC ..... *B41J 2/04588* (2013.01); *B41J 2/0459* (2013.01); *B41J 2/04581* (2013.01); *B41J 2/04596* (2013.01)

(58) Field of Classification Search
CPC ..... B41J 2/045; B41J 2/04581; B41J 2/0459; B41J 2/04596
See application file for complete search history.

(56) References Cited

U.S. PATENT DOCUMENTS 8,777,346 B2 * 7/2014 Satou ..... B41J 29/02 347/10
8,960,833 B2 2/2015 Satou et al.
2013/0063507 A1 * 3/2013 Sasaki ..... B41J 29/38 347/11
2014/0022294 A1 1/2014 Satou et al.

FOREIGN PATENT DOCUMENTS

| | | |
|---|---|---|
| JP | 2013-103460 | 5/2013 |
| JP | 2014-19050 | 2/2014 |
| JP | 2014-188714 | 10/2014 |

OTHER PUBLICATIONS

Abstract and machine translation of JP 2013-103460.
Abstract and machine translation of JP 2014-188714.

* cited by examiner

*Primary Examiner* — Julian Huffman
(74) *Attorney, Agent, or Firm* — Fildes & Outland, P.C.

(57) ABSTRACT

A drive waveform generation device includes a generation unit that generates a drive waveform having, as each cycle, a first waveform for droplet ejection or a second waveform for vibrating a liquid meniscus by selecting from a first period having a first potential that is lower than a reference potential, a second period following the first period continuously and having a second potential that is higher than or equal to the reference potential, a third period following the second period continuously and having a third potential that is higher than the first potential and lower than the second potential, and a fourth period following the third period continuously and having a fourth potential that is higher than the first potential and lower than the third potential, the first period, the second period, the third period and the fourth period being included in a fundamental waveform as defined herein.

18 Claims, 8 Drawing Sheets

DRIVE WAVEFORM GENERATION DEVICE AND IMAGE FORMING APPARATUS

CROSS-REFERENCE TO RELATED APPLICATIONS

This application is based on and claims priority under 35 USC 119 from Japanese Patent Application No. 2016-172974 filed on Sep. 5, 2016.

BACKGROUND

Technical Field

The present invention relates to a drive waveform generation device and an image forming apparatus.

SUMMARY

According to an aspect of the invention, there is provided a drive waveform generation device comprising a generation unit that generates a drive waveform having, as each cycle, a first waveform for droplet ejection or a second waveform for vibrating a liquid meniscus by selecting from a first period having a first potential that is lower than a reference potential, a second period that follows the first period continuously and has a second potential that is higher than or equal to the reference potential, a third period that follows the second period continuously and has a third potential that is higher than the first potential and lower than the second potential, and a fourth period that follows the third period continuously and has a fourth potential that is higher than the first potential and lower than the third potential, the first period, the second period, the third period, and the fourth period being included in a fundamental waveform, wherein the generation unit generates the first waveform using the first potential, the second potential, the third potential, and the fourth potential of the fundamental waveform and generates the second waveform using at least one of the second potential and the third potential of the fundamental waveform.

BRIEF DESCRIPTION OF THE DRAWINGS

Exemplary embodiments of the present invention will be described in detail based on the following figures, wherein.

[Description of symbols]

Figure 1:
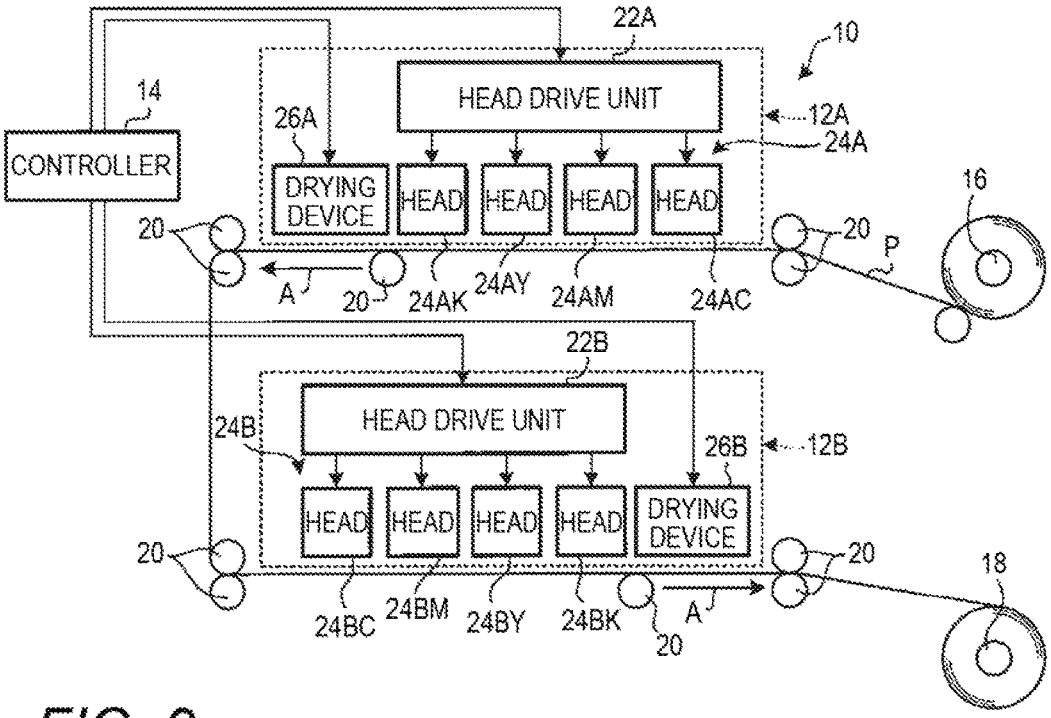
FIG. 1 is a schematic diagram showing example main components of an image forming apparatus according to a first exemplary embodiment of the present invention.

10: Image forming apparatus
12 (12A, 12B): Image forming unit
14: Controller
16: Sheet supply roll
18: Take-up roll
20: Conveying rollers
22 (22A, 22B): Head drive unit
22D: Parasitic diode
22S: Switching element
24 (24A, 24B): Heads
26 (26A, 26B): Drying device
24AC, 24AM, 24AY, 24AK: Head
24BC, 24BM, 24BY, 24BK: Head
30: Droplet ejection member
32: Nozzle
34: Pressure room
36: Supply opening
38: Common flow passage
40: Vibration plate
42: Piezoelectric element
40A: Common electrode
42A: Individual electrode
50: CPU
50A: Generation unit
52: RAM
54: ROM
56: I/O
58: Bus
60: Microcomputer
62: UI
64: HDD
66: Communication I/F
68: Device I/F
70: Drive waveform generation device

DETAILED DESCRIPTION

Example modes for carrying out the present invention will be hereinafter described in detail with reference to the drawings.

[Exemplary Embodiment 1]

FIG. 1 is a schematic diagram showing example main components of an image forming apparatus 10 according to a first exemplary embodiment. As shown in FIG. 1, the image forming apparatus 10 is equipped with two image forming units 12A and 12B for forming images on the two respective surfaces of a sheet P as it is conveyed once, a controller 14, a sheet supply roll 16, a sheet take-up roll 18, and plural conveying rollers 20. The sheet P is an example of the "recording medium".

The image forming unit 12A is equipped with a head drive unit 22A, heads 24A, and a drying device 26A. Likewise, the image forming unit 12B is equipped with a head drive unit 22B, heads 24B, and a drying device 26B.

In the following description, when the image forming units 12A and 128 need not be discriminated from each other or the same components included in the image forming units 12A and 12B need not be discriminated from each other, characters "A" and "B" included in their reference symbols may be omitted.

The controller 14 controls the rotation of the conveying rollers 20 via, for example, a mechanism (not shown) including a sheet conveying motors, gears, etc. by driving the sheet conveying motor.

A long sheet P is wound around the sheet supply roll 16, and the sheet P is conveyed in the direction (sheet feeding direction) indicated by arrow A in FIG. 1 as the conveying rollers 20 are rotated.

The controller 14 forms an image corresponding to image information on one image forming surface of the sheet P by controlling the image forming unit 12A on the basis of pieces of color information of respective image pixels included in the image information.

More specifically, the controller 14 controls the head drive unit 22A. The head drive unit 22A drives the heads 24A connected to the head drive unit 22A according to droplet ejection timing instructions given from the controller 14 and thereby causes the heads 24A to eject droplets. An image corresponding to image information is formed by the elected droplets on the one image forming surface of the sheet P being conveyed.

Color information of each of image pixels included in image information includes pieces of information that indicates a color of the pixel uniquely. Although in the exemplary embodiment the color information of each image pixel is represented by densities of yellow (Y), magenta (M), cyan (C), and black (K), another method for representing the color information of each image pixel uniquely may be employed.

The heads 24A are four heads 24AY, 24AM, 24AC, and 24AK which correspond to the four respective colors Y, M, C, and K and eject droplets of the respective colors.

The controllers 14 controls the drying device 26A and thereby causes it to dry image droplets formed on the sheet P to fix the image on the sheet P.

As the conveying rollers 20 are rotated, the image forming region of the sheet P is conveyed to such a position as to be opposed to the image forming unit 12B. Before reaching that position, the sheet P is flipped so that the image forming surface that is different from that on which the image has been formed by the image forming unit 12A will be opposed to the image forming unit 12B.

The controller 14 performs, on the image forming unit 12B, the same control as was performed on the image forming unit 12A and thereby forms an image corresponding to image information on the other image forming surface of the sheet P.

The heads 24B are four heads 24BY, 24BM, 24BC, and 24BK which correspond to the four respective colors Y, M, C, and K and eject droplets of the respective colors.

The controller 14 controls the drying device 26B and thereby causes it to dry image droplets formed on the sheet P to fix the image on the sheet P.

The sheet P is thereafter conveyed to the take-up roll 18 as the conveying rollers 20 are rotated, and is taken up by the take-up roll 18.

Although in the image forming apparatus 10 according to the exemplary embodiment is configured in such a manner that images are formed on the front and back surfaces of the sheet P as it is conveyed once from the sheet supply roll 16 to the take-up roll 18, the concept of the exemplary embodiment can also be applicable to a case that an image is formed on only one surface of a sheet P.

In the exemplary embodiment, the term "ink" (corresponding to the term "liquid") includes a water-based ink, an oil-based ink, an ultraviolet-curing ink, and the like. Likewise, the term "ink droplet" (corresponding to the term "liquid droplet") includes a water-based ink droplet, an oil-based ink droplet, an ultraviolet-curing ink droplet, and the like.

Figure 2:
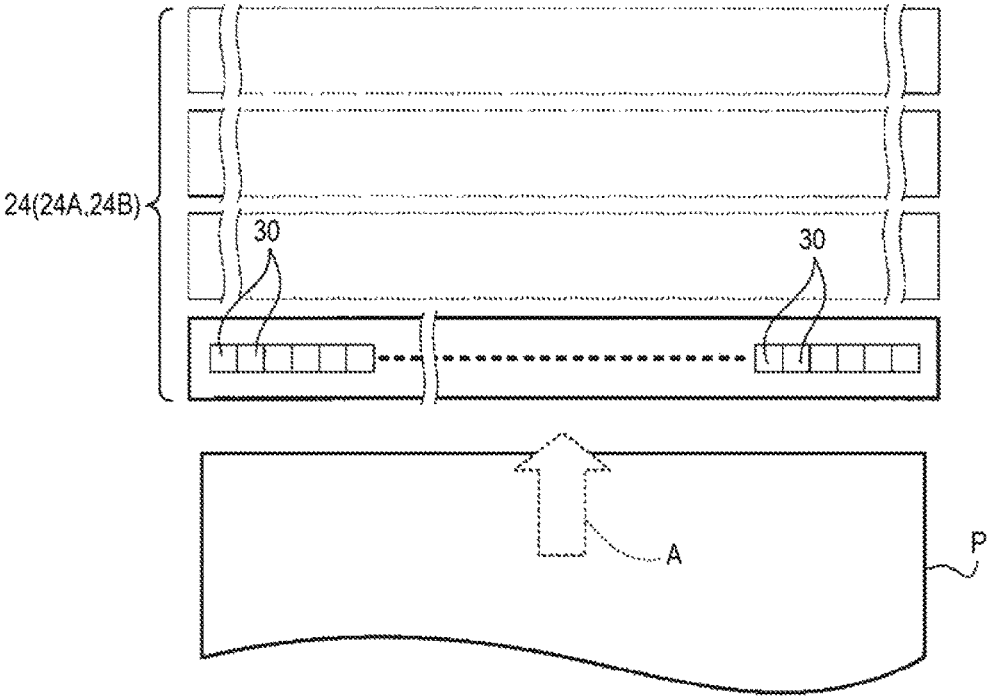
FIG. 2 is a front view of an example of each head of the image apparatus according to the first exemplary embodiment.

FIG. 2 is a front view of an example of each head 24 of the image forming apparatus 10 according to the exemplary embodiment. As shown in FIG. 2, in each head 24 used in the image forming unit 12, plural droplet ejection members 30 are arranged in the head longitudinal direction. The head longitudinal direction is a direction that crosses the sheet P feeding direction (indicated by arrow A in FIG. 2) and may also be called a main scanning direction. The sheet P feeding direction may also be called an auxiliary scanning direction.

The arrangement of the droplet ejection members 30 in the main scanning direction is not limited to the case that they are arranged in a single arrangement line. Depending on the dot pitch (resolution), the droplet ejection members 30 may be arranged two-dimensionally in plural arrangement lines that are arranged in the auxiliary scanning direction, according to predetermined rules. In this case, ejection timing is controlled between the plural arrangement lines according to the arrangement line pitch and a sheet P feeding speed.

Figure 3:
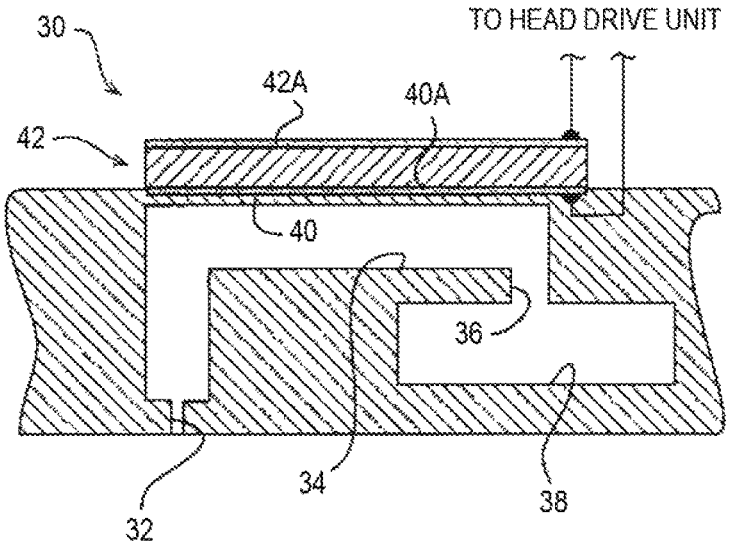
FIG. 3 is a sectional view of an example of each droplet ejection member that is provided in each head employed in the first exemplary embodiment.

FIG. 3 is a sectional view of an example of each droplet ejection member 30 provided in each head 24 that is employed in the exemplary embodiment. As shown in FIG. 3, each droplet ejection member 30 is equipped with a nozzle 32 and a pressure room 34 that is connected to the nozzle 32.

The pressure room 34 is provided with a supply opening 36. The pressure rooms 34 of the plural droplet ejection members 30 are connected to a common flow passage 38 via the respective supply openings 36.

The common flow passage 38 has a role of being supplied with ink from an ink supply tank (ink supply source; not shown) and distributes it to the pressure rooms 34 of the plural droplet ejection members 30.

A piezoelectric element 42, which is an example of the "drive element", is attached to the top surface of a ceiling portion of the pressure room 34 of the droplet ejection member 30. The piezoelectric element 42 produces pressure waves in the ink existing in the pressure room 34 and thereby causes an ink droplet from the nozzle 32 which is connected to the pressure room 34. More specifically, a pressure is exerted instantaneously on the ink existing in the pressure room 34 when the piezoelectric element 42 is deformed, whereby ink, that is, an ink droplet, is ejected from the nozzle 32 which is connected to the pressure room 34.

A vibration plate 40 is attached to the top surface of the ceiling portion of the pressure room 34. Whereas the vibration plate 40 is provided with a common electrode 40A, the piezoelectric element 42 is provided with an individual electrode 42A. When the piezoelectric element 42 is selected and a voltage is applied between the individual electrode 42A of the piezoelectric element 42 and the common electrode 40A, the piezoelectric element 42 is deformed and an ink droplet is ejected from the nozzle 32. At the same time, new ink is supplied to the pressure room 34 from the common flow passage 38.

The controller 14 shown in FIG. 1 controls the head drive units 22 (22A and 22B) on the basis of image information and thereby generates control signals to be used for applying independent voltages to the individual electrodes 42A of the piezoelectric elements 42, respectively.

Figure 4:
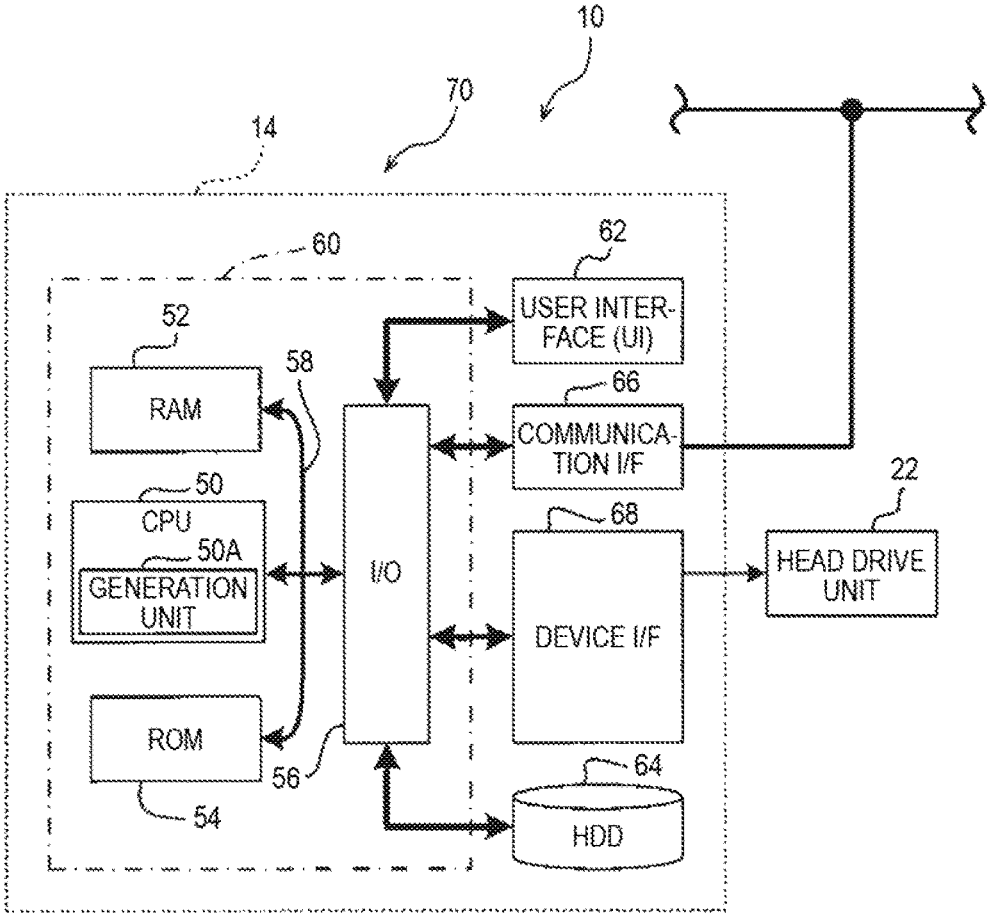
FIG 4. is a block diagram showing the configuration of an example drive waveform generation device of the image forming apparatus according to the first exemplary embodiment.

FIG. 4 is a block diagram showing the configuration of an example drive waveform generation device 70 of the image forming apparatus 10 according to the exemplary embodiment. As shown in FIG. 4, the drive waveform generation device 70 according to the exemplary embodiment is equipped with the above-described controller 14 and head drive unit 22. As such, the drive waveform generation device 70 is provided as part of the image forming apparatus 10.

The controller 14 is equipped with a microcomputer 60. The microcomputer 60 is equipped with a CPU (central processing unit) 50, a RAM (random access memory) 52, a ROM (read-only memory) 54, and an input/output interface (I/O) 56 which are connected to each other by a bus 58.

A user interface (UI) 62, functional units including an HDD (hard disk drive) 64, a communication interface (I/F) 66, a device interface (I/F) 68 are connected to the I/O 56. The UI 62 is a manipulation unit including a touch panel, manipulation buttons, etc. for receiving a manipulation input from a user. The communication I/F 66 is a communication unit for performing a wireless or wired communication with an external device. The head drive unit 22 (and the drying device 26 (not shown in FIG. 4) is connected to the device I/F 68. These functional units can communicate with the CPU 50 mutually via the I/O 56.

The controller 14 may be part of a main controller which controls the operation of the overall image forming apparatus 10. Part or all of the blocks of the controller 14 are implemented as an integrated circuit such as an LSI (large scale integration) or an IC (integrated circuit) chip set. The controller 14 may be implemented in such a manner that each block of the controller 14 is an individual circuit or part or all of it are an integrated circuit. The controller 14 may be implemented in such a manner that its blocks are integrated together or part of the blocks are provided separately from the other blocks. Part of each block may be provided separately. Integration in the controller 14 may be done in the form of not only an LSI but also a dedicated circuit or a general-purpose processor.

The HDD 64 is stored with a program that allows the CPU 50 to function as a generation unit 50A (described later). This program may be stored in the ROM 54. This program may be either preinstalled in the image forming apparatus 10 (drive waveform generation device 70) or installed in the image forming apparatus 10 (drive waveform generation device 70) when necessary in such a manner that it is stored in a nonvolatile storage medium or distributed over a network. Examples of the nonvolatile storage medium are a CD-ROM, a magneto-optical disc, an HDD, a DVD-ROM, a flash memory, and a memory card.

Incidentally, in inkjet image forming apparatus such as the image forming apparatus 10 according to the exemplary embodiment, to prevent undue increase of the viscosity of ink at the surface of each nozzle, a waveform (hereinafter referred to as a "non-ejection waveform") for causing very small vibration of an ink meniscus during an ink non-ejection period may be applied to each drive element. The term "meniscus" means a convex or concave surface that is formed by interfacial tension at the surface of an ink existing in a nozzle opening. A conventional technique is known in which a non-ejection waveform for meniscus vibration control and an ejection waveform for image formation are generated separately from each other in one drive waveform. However, in this technique, the one-cycle length of a drive waveform becomes long.

In contrast, the drive waveform generation device 70 according to the exemplary embodiment is equipped with a generation unit 50A. In the exemplary embodiment, the CPU 50 functions as the generation unit 50A by writing a program stored in the HDD 64 to the RAM 52 and running it.

The generation unit 50A generates a drive waveform having, as each cycle, an ink droplet ejection waveform or an ink droplet non-ejection waveform by selecting from four periods, having respective potentials, of a fundamental waveform. The drive waveform is generated on the basis of, that is, by repeating, the repetitive fundamental waveform having the above four periods.

More specifically, in an ink droplet ejection period, the generation unit 50A generates an ejection waveform using the whole fundamental waveform. In an ink droplet non-ejection period, the generation unit 50A generates a non-ejection waveform using part of the fundamental waveform.

The ejection waveform is an example of the first waveform, and the non-election waveform is an example of the second waveform. The non-election waveform is also called a tickle waveform. The above four periods, fundamental waveform, ejection waveform, and non-ejection waveform will be described later.

According to the exemplary embodiment, the one-cycle length of a drive waveform is shortened because part of an ejection waveform for image formation is also used to form a non-ejection waveform for meniscus vibration control, as a result of which the drive frequency is increased.

Figure 5:
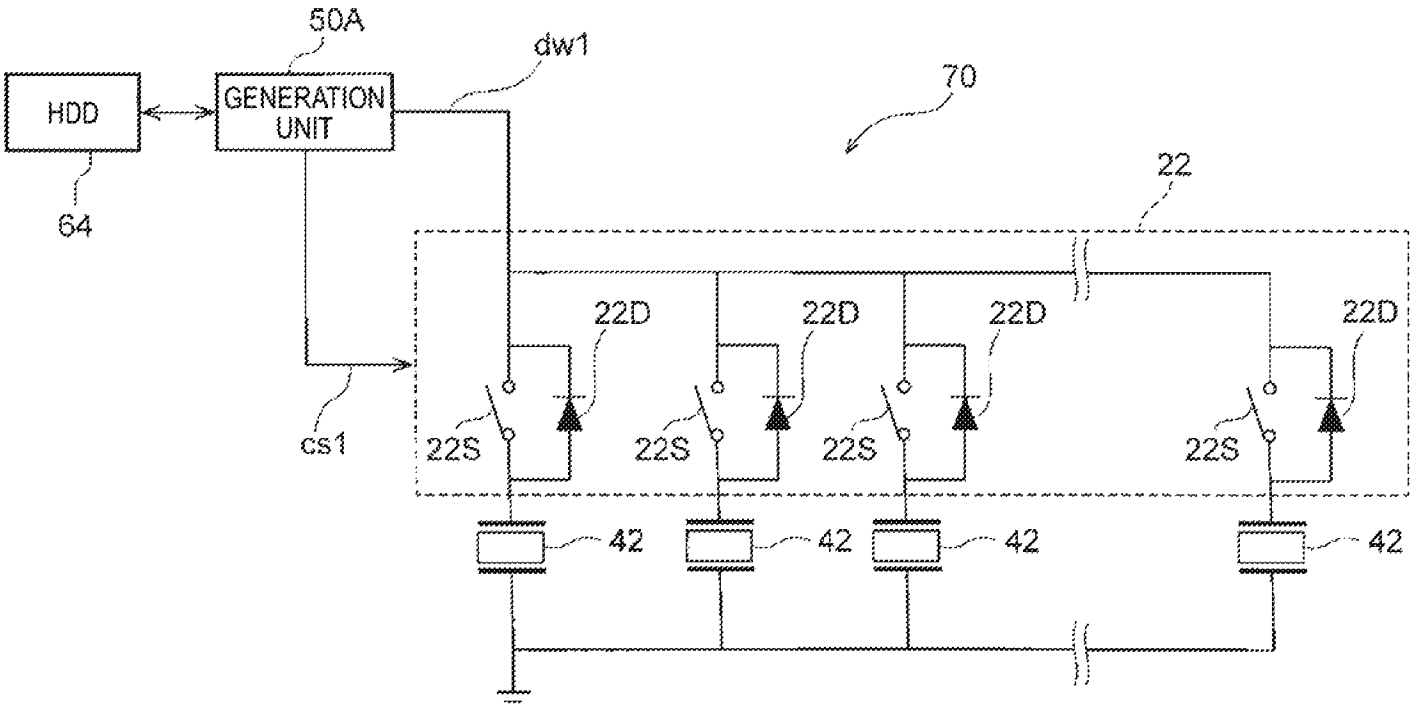
FIG. 5 is a diagram showing an example circuit configuration of a head drive unit of the drive waveform generation device according to the first exemplary embodiment.

A specific configuration of the drive waveform generation device 70 will be described below with reference to FIG. 5. FIG. 5 is a diagram showing an example circuit configuration of the head drive unit 22 of the drive waveform generation device 70 according to the exemplary embodiment. As shown in FIG. 5, the generation unit 50A outputs a signal dw1 (hereinafter referred to simply as a "drive waveform dw1") indicating a drive waveform to the head drive unit The head drive unit 22 includes plural switching elements 22S which are provided so as to be one-to-one correspondence with the plural piezoelectric elements 42. Each switching element 22S is a MOSFET (metal-oxide-semiconductor field-effect transistor), for example. In this case, because of the structure of the MOSFET, a parasitic diode 22D is formed parallel with the switching element 22S.

To cause each nozzle 32 (see FIG. 3) to eject an ink droplet for one pixel, the drive waveform dw1 includes plural pulses in a predetermined drive cycle. Data indicating the drive waveform dw1 is stored in the HDD 64 (or ROM 54), for example. To facilitate the description, the exemplary embodiment is directed to a case of using only one kind of drive waveform dw1. However, for example, plural kinds of drive waveforms dw1 may be stored that correspond to respective ink droplet sizes (e.g., a small droplet, a medium droplet, and a large droplet).

The generation unit 50A also outputs, to the switching element 22S, control signals cs1, which are signals for on/off-controlling the plural switching elements 22S in a time-divisional manner. With the time-divisional control, a pulse(s) to be applied to each piezoelectric element 42 is selected from the plural pulses included in the drive waveform dw1. The generation unit 50A is configured so as to be able to output control signals cs1 to the plural respective switching elements 22S individually.

That is, the generation unit 50A output control signals cs1 to the plural respective switching elements 22S individually while outputting the same drive waveform dw1 to the plural switching elements 22S. Each switching element 22S starts application of the drive waveform dw1 to the corresponding piezoelectric element 42 with such timing that it receives a turn-on-indicative control signal cs1 from the generation unit 50A, and finishes the application of the drive waveform dw1 to the corresponding piezoelectric element 42 with such timing that it receives a turn-off-indicative control signal cs1 from the generation unit 50A.

Figure 6:
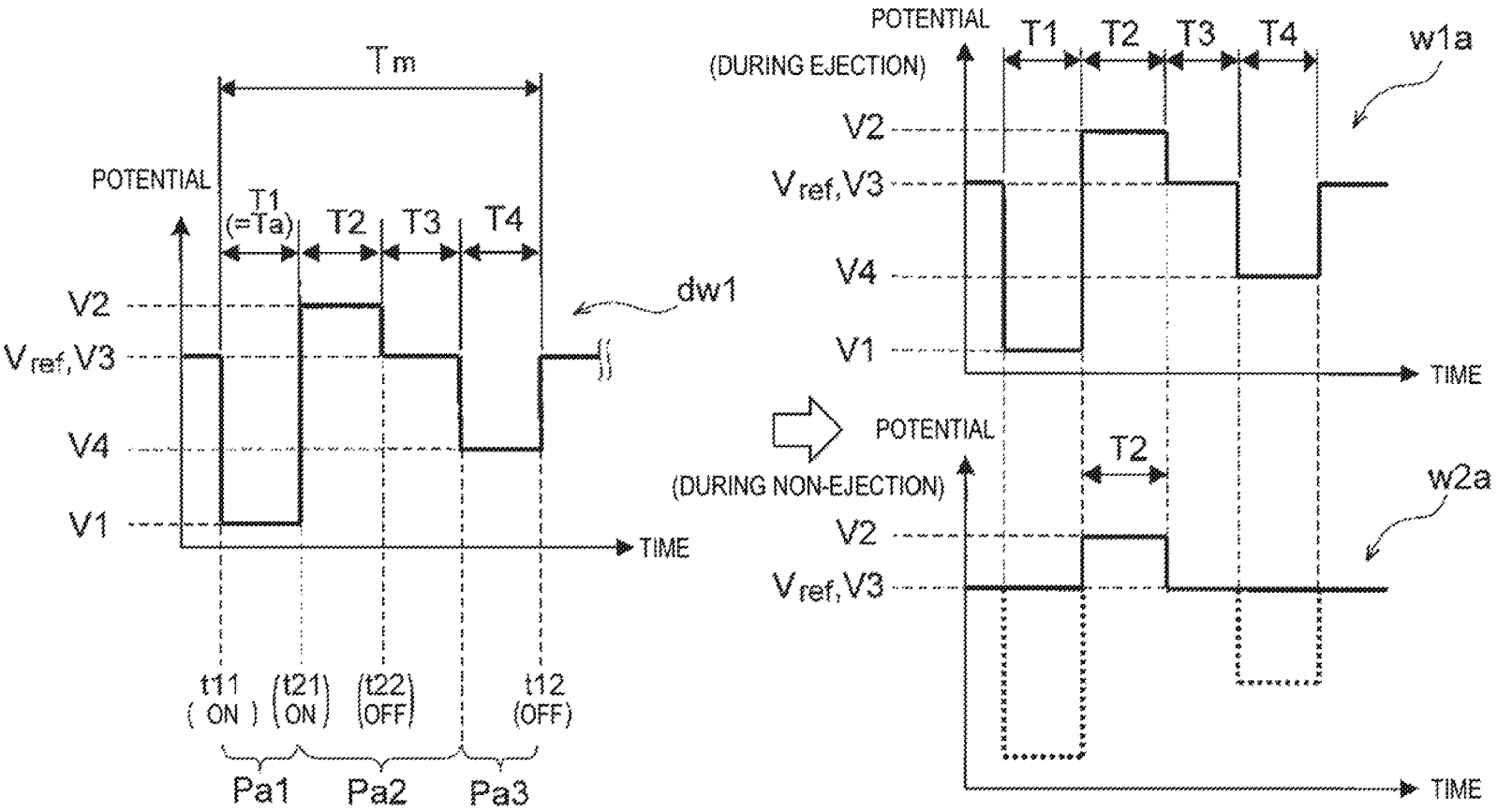
FIG. 6 is waveform diagrams showing an example ejection waveform for image formation and an example non-ejection waveform for meniscus vibration control which are generated by the drive waveform generation device according to the first exemplary embodiment.

FIG. 6 is waveform diagrams showing an example ejection waveform w1a for image formation and an example non-ejection waveform w2a for meniscus vibration control which are generated by the drive waveform generation device 70 according to the first exemplary embodiment. In FIG. 6, the vertical axis and the horizontal axis represent the potential and time, respectively.

As shown in the left part of FIG. 6, a drive waveform dw1 is input continuously to the switching elements 22S from the generation unit 50A. One cycle Tm of the drive waveform dw1 includes four periods, that is, a first period T1, a second period T2, a third period T3, and a fourth period T4. A reference potential Vref to serve as a potential reference for plural pulses included in the drive waveform dw1 is set in the drive waveform dw1 in advance. For example, the reference potential Vref is a potential corresponding to a case that the pressure room 34 (see FIG. 3) has a reference capacity (for expansion or contraction).

The first period T1 is a period in which the potential of the drive waveform dw1 is at a first potential V1 that is lower than the reference potential Vref. The second period T2 is a period that follows the first period T1 continuously and in which the potential is at a second potential V2 that is higher than or equal to (in this example, higher than) the reference potential Vref. The third period T3 is a period that follows the second period T2 continuously and in which the potential is at a third potential V3 that is higher than the first potential V1 and lower than the second potential V2. In this example, the third potential V3 is equal to the reference potential Vref. The fourth period T4 is a period that follows the third period T3 continuously and in which the potential is at a fourth potential V4 that is higher than the first potential V1 and lower than the third potential V3. The waveform having the first period T1 the fourth period T4 is an example of the "fundamental waveform". The drive waveform dw1 is generated in such a manner that the waveform having the first period T1 to the fourth period T4 occurs repeatedly.

In an ink droplet election period, the generation unit 50A outputs a control signal cs1 to the switching element 22S so that it is turned on at time t11 while outputting the drive waveform dw1 to the switching element 22S. The generation unit 50A outputs the control signal cs1 to the switching element 22S so that it is turned off at time t12. The switching element 22S is thus on/off-controlled the control signal cs1, whereby an election waveform w1*a* (first waveform) for image formation is generated as shown in the top-right part of FIG. 6.

The ejection waveform w1*a* is a one-cycle (Tm) waveform of the drive waveform dw1 and has the above-mentioned first period T1, second period T2, third period T3, and fourth period T4. That is, the ejection waveform w1a is a waveform that is generated using all of the first potential V1 in tile first period T1, the second potential V2 in the second period T2, the third potential V3 in the third period T3, and the fourth potential V4 in the fourth period T4.

In the first exemplary embodiment, the ejection waveform w1*a* includes three pulses, that is, an ejection pulse Pa1, a control pulse Pa2, and a suppression pulse Pa3. The ejection pulse Pa1 is a pulse that is formed by the first potential V1 and serves for ejection of an ink droplet. The first period T1 is a period corresponding to the pulse width of the ejection pulse Pa1.

The control pulse Pa2 is a pulse that is formed by the second potential V2 and the third potential V3 and serves to control a tail portion of an ink droplet being ejected. The second period T2 and the third period T3 constitute a period corresponding to the pulse width of the control pulse Pa2. The tail portion is a satellite droplet portion that is ejected following a main droplet of an ink droplet continuously and is smaller than the main droplet.

The suppression pulse Pa3 is a pulse that is formed by the fourth potential V4 and serves to suppress residual vibration that is caused by pressure waves occurring in the pressure room 34 after ejection of an ink droplet. The fourth period T4 is a period corresponding to the pulse width of the suppression pulse Pa3.

On the other hand, in an ink droplet non-ejection period, the generation unit 50A outputs a control signal cs1 to the switching element 22S so that it is turned on at time t21 while outputting the rive waveform dw1 to the switching element 22S. The generation unit 50A outputs the control signal cs1 to the switching element 22S so that it is turned off at time t22. The switching element 22S is thus on/off controlled by the control signal cs1, whereby a non-ejection waveform w2*a* (second waveform) for meniscus vibration control is generated as shown in the bottom-right part of FIG. 6. In the first exemplary embodiment, the non-ejection waveform w2*a* is a waveform that has the second period T2 (which is part of the control pulse Pa2) and is generated using the second potential V2 in the second period T2.

While the switching element 22S is off, the potential of the drive waveform dw1 is kept at the reference potential Vref by the parasitic diode 22D.

The potential of the above-described non-election waveform w2*a* is not set at the third potential V3 because the third potential V3 in the third period T3 is equal to the reference potential Vref. The potential of the non-election waveform w2*a* may be set at the third potential V3 in the case where the third potential V3 is different from the reference potential Vref. As a further alternative, a non-ejection waveform w2*a* may be generated using both of the second potential V2 and the third potential V3.

In the first exemplary embodiment, the first period T1, the second period T2, the third period T3, and the fourth period T4 have the same length (=Ta). That is, the length of the ejection waveform w1a is equal to 4×Ta. And the length of the non-ejection waveform w2*a* is equal to Ta. The term "same" used above means that the periods T1-T4 have the same length in a sense that each of them includes a predetermined error.

It is desirable that the length Ta of the first period T1 be 1/2 times the natural period of pressure waves occurring in the pressure room 34. The natural period is a period (cycle time) that is determined for a head uniquely depending on the shapes, dimensions, stiffness, etc. of members such as the nozzle, the pressure room, the ink supply opening, and the piezoelectric element constituting the head.

Setting the lengths of the first period T1, the second period T2, the third period T3, and the fourth period T4 equal to the natural period makes it possible to suppress occurrence of excessive vibration of the head 24 and the piezoelectric elements 42 and to thereby enable stable ejection of droplets. Alternatively, the length Ta of the first period T1 may be set equal to a pulse width that maximizes the ejection speed or ejection amount of an ink droplet. This setting also makes it possible to suppress occurrence of excessive vibration of the head 24 and the piezoelectric elements 42 and to thereby enable stable ejection of droplets.

On the other hand, in the first exemplary embodiment, the difference between the second potential V2 and the reference potential Vref is smaller than the difference between the fourth potential V4 and the reference potential Vref. And the difference between the third potential V3 and the reference potential Vref is smaller than the difference between the fourth potential V4 and the reference potential Vref.

If the difference between the potential of the non-ejection waveform w2*a* the reference potential Vref is relatively large, ejection of an ink droplet may occur. For example, if the fourth potential V4 in the fourth period T4 used as the potential of the non-ejection waveform w2*a*, ejection of an ink droplet may occur. In view of this, in the first exemplary embodiment, as described above, the potential of the non-ejection waveform w2*a* is set equal to the second potential V2 which has a relatively small difference from the reference potential Vref. It is desirable that the potential of the non-ejection waveform w2*a* be set equal to a potential (in the exemplary embodiment, second potential V2) that is closest to the reference potential Vref among the plural potentials of the ejection waveform w1*a*. Ejection of an ink droplet due to application of the non-ejection waveform w2*a* suppressed by setting the potential of the non-ejection waveform w2*a* equal to a potential having a relatively small difference from the reference potential Vref.

Figure 7:
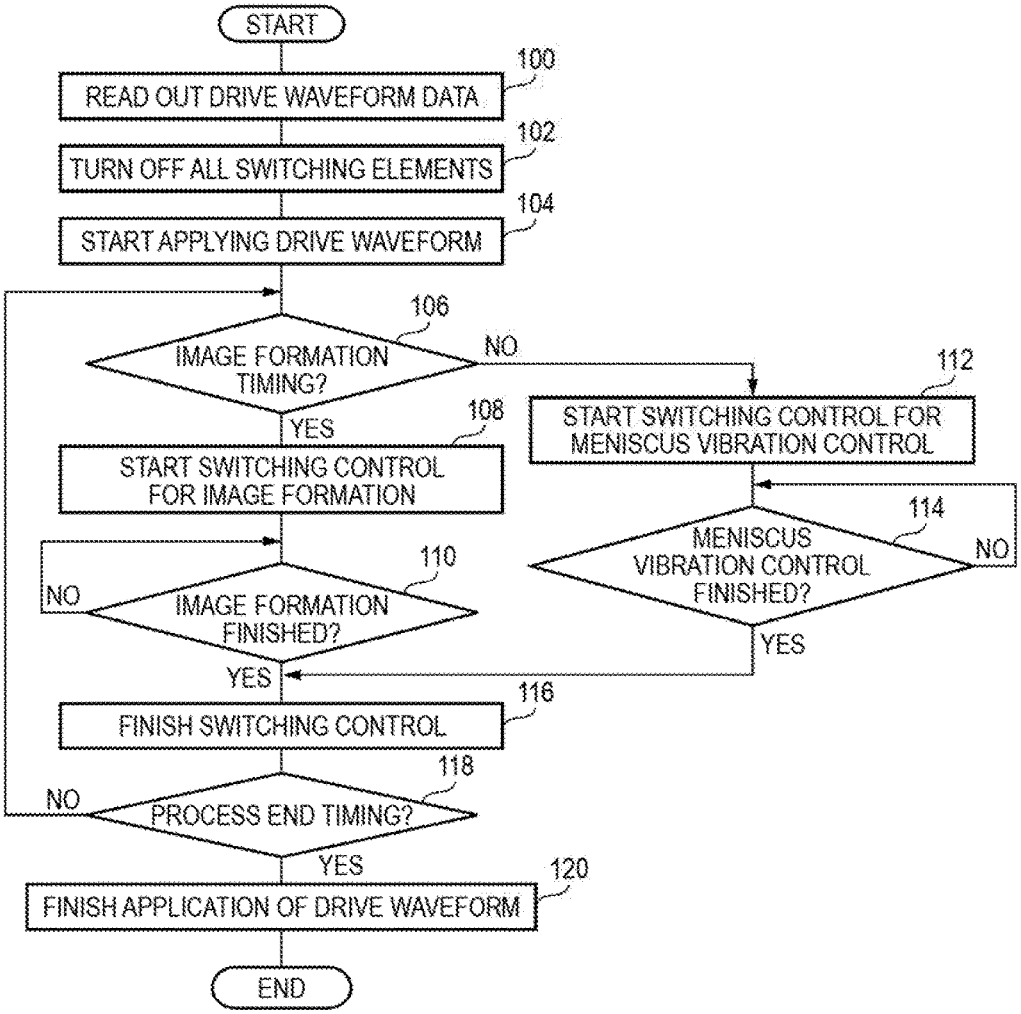
FIG. 7 is a flowchart illustrating an example process of a program employed in the first exemplary embodiment.
Figure 8:
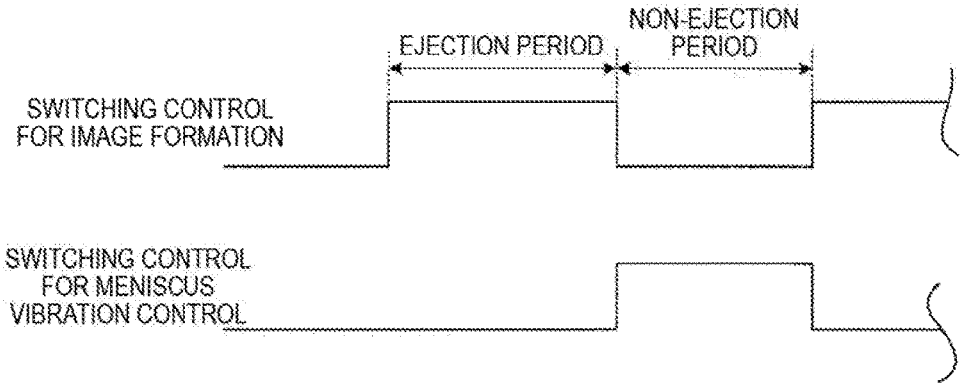
FIG. 8 is a timing chart illustrating a switch control for image formation and a switch control for meniscus vibration control in the first exemplary embodiment.

Next, referring to FIGS. 7 and 8, a description will be made of how the generation unit 50A of the image forming apparatus 10 according to the first exemplary embodiment works. FIG. 7 is a flowchart illustrating an example process of the program employed in the first exemplary embodiment. FIG. 8 is a timing chart illustrating a switch control for image formation and a switch control for meniscus vibration control in the first exemplary embodiment.

As soon as the power switch of the image forming apparatus 10 is turned on and the image forming apparatus 10 is started, the CPU 50 writes the program stored in the HDD 64 to the RAM 52 and runs it to function as the generation unit 50A.

First, at step 100 shown in FIG. 7, the generation unit 50A reads out the data indicating the drive waveform dw1 from the HDD 64.

At step 102, the generation unit 50A turns off all of the switching elements 22S of the head drive unit 22.

At step 104, the generation unit 50A starts applying the drive waveform dw1. At this time point, the drive waveform dw1 is not applied to the piezoelectric elements 42 because all of the switching element 22S are off .

At step 106, the generation unit 50A judges whether image formation timing has arrived or not. The image formation timing is timing of reception of an image formation instruction from a user via the UI 62 or the communication interface 66 (see FIG. 4). If the generation unit 50A judges that image formation timing has arrived (step 106: yes), the process moves to step 108. On the other hand, if the generation unit 50A judges that image formation timing has not arrived yet (step 105: no), the process moves to step 112.

At step 108, the generation unit 50A starts a switching control for image formation and outputs control signals cs1 to the respective switching element 22S. The specific switching control method has already been described above with reference to FIG. 6 and hence will not be described here repeatedly.

At step 110, the generation unit 50A judges whether the image formation has been finished or not. If the generation unit 50A judges that the image formation has been finished (step 110: yes), the process moves to step 116. On the other hand, if the generation unit 50A judges that the image formation has not been finished yet (step 110: no), the process stands by at step 110.

At step 116, the generation unit 50A finishes the switching control for image formation.

At step 112, the generation unit 50A starts switching control for a meniscus vibration control and outputs the same control signal cs1 to the switching elements 22S. The specific switching control method has already been described above with reference to FIG. 6 and hence will not be described here repeatedly.

At step 114, the generation unit 50A judges whether the meniscus vibration control has been finished or not. If the generation unit 50A judges that the meniscus vibration control has been finished (step 114: yes), the process moves to step 116. If the generation unit 50A judges that the meniscus vibration control has not been finished yet (step 114: no), the process stands by at step 114.

At step 116, the generation unit 50A finishes the switching control for the meniscus vibration control. Now, referring to the timing chart of FIG. 8, a description will be made of example switching controls performed at steps 108 and 112, respectively.

In FIG. 8, the high-level period of each of the switching control for image formation and the switching control for a meniscus vibration control is a period during which a switching control is performed on the switching element 22S. That is, in the switching control for image formation, a switching control is performed on the switching element 22S in an ink droplets ejection period. In the switching control for a meniscus vibration control, a switching control is performed on the switching element 22S in an ink droplets non-ejection period.

Returning to FIG. 7, at step 118, the generation unit 50A judges whether process end timing has arrived or not. For example, the process end timing is timing of reception of an image formation end instruction from the user via the UI 62 or the communication interface 66 or timing of depression of the power switch of the image forming apparatus 10 by the user. If the generation unit 50A judges that process end timing has arrived (step 118: yes), the process moves to step 120. On the other hand, the generation unit 50A judges that process end timing has not arrived yet (step 118: no), the process returns to step 106.

At step 120, the generation unit 50A finishes the application of the drive waveform dw1 and finishes the execution of the process. This process is directed to the case that the drive waveform dw1 of the first exemplary embodiment is used. The same process is executed also when each of drive signals dw2 to dw4 according to second to fourth exemplary embodiments is used.

As described above, in the first exemplary embodiment, at least one of the second potential V2 in the second period T2 and the third potential V3 in the third period T3 of the ejection waveform w1a for image formation is also used to form the non-ejection waveform w2*a* for meniscus vibration control, as a result of which the one-cycle (Tm) length of the drive waveform dw1 is shortened and hence the drive frequency is increased.

[Exemplary Embodiment 2]

Figure 9:
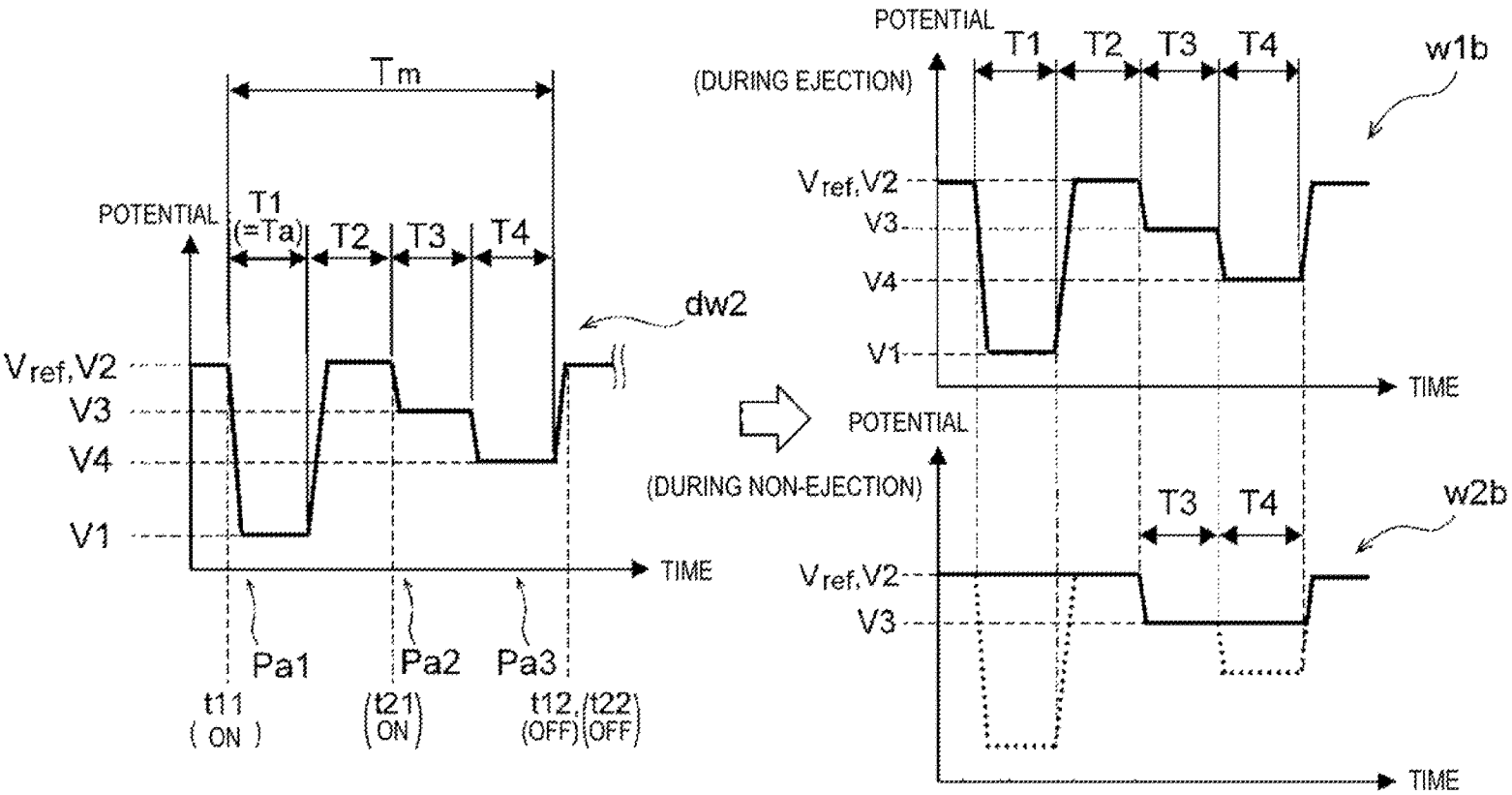
FIG. 9 is waveform diagrams showing an example ejection waveform for image formation and an example non-ejection waveform for meniscus vibration control which are generated by a drive waveform generation device according to a second exemplary embodiment.

FIG. 9 is waveform diagrams showing an example ejection waveform w1*b* for image formation and an example non-ejection waveform w2*b* for meniscus vibration control which are generated by a drive waveform generation device 70 according to a second exemplary embodiment. In FIG. 9, the vertical axis and the horizontal axis represent the potential and time, respectively. The configuration of the drive waveform generation device 70 according to the second exemplary embodiment is basically the same as that according the first exemplary embodiment, and the common part of the configuration of the former will not be described below.

As shown in the left part of FIG. 9, a drive waveform dw2 is input continuously to the switching elements 22S from the generation unit 50A. In the drive waveform dw2, pulse rising edges and trailing edges are inclined, which prevents occurrence of circuit damage when a large current flows suddenly at the time of switching. One cycle Tm of the drive waveform dw2 includes four periods, that is, a first period T1, a second period T2, a third period T3, and a fourth period T4.

The first period T1 is a period in which the potential of the drive waveform dw2 is at a first potential V1 that is lower than the reference potential Vref. The second period T2 is a period that follows the first period T1 continuously and in which the potential is at a second potential V2 that is higher than or equal to (in this example, equal to) the reference potential Vref. The third period T3 is a period that follows the second period T2 continuously and in which the potential is at a third potential V3 that is higher than the first potential V1 and lower than the second potential V2. The fourth period T4 is a period that follows the third period T3 continuously and in which the potential is at a fourth potential V4 that is higher than the first potential V1 and lower than the third potential V3. The waveform having the first period T1 to the fourth period T4 is another example of the "fundamental waveform". The drive waveform dw2 is generated in such a manner that the waveform having the first period T1 to the fourth period T4 occurs repeatedly.

As shown in the top-right part of FIG. 9, the generation unit 50A generates an ejection waveform w1*b* (first waveform) for image formation. The ejection waveform w1*b* is a one-cycle (Tm) waveform of the drive waveform dw2 and has the above-mentioned first period T1, second period T2, third period T3, and fourth period T4. That is, the ejection waveform w1*b* is a waveform that is generated using all of the first potential V1 in the first period T1, the second potential V2 in the second period T2, the third potential V3 in the third period T3, and the fourth potential V4 in the fourth period T4.

In the second exemplary embodiment, as in the first exemplary embodiment, the drive waveform dw2 (and the ejection waveform w1b) includes three pulses, that is, an ejection pulse Pa1, a control pulse Pa2, and a suppression pulse Pa3.

On the other hand, as shown in the bottom-right part of FIG. 9, the generation unit 50A generates a non-election waveform w2*b* (second waveform) for meniscus vibration control. In the second exemplary embodiment, the non-ejection waveform w2*b* is a waveform that has the third period T3 (which is part of the period of the control pulse Pa2) and the fourth period T4 of the suppression pulse Pa3 and is generated using the third potential V3 in the second period T3.

The potential of the above-described non-ejection waveform w2*b* is not set at the second potential V2 because the second potential V2 in the second period T2 is equal to the reference potential Vref. The potential of the non-ejection waveform w2*b* may be set at the second potential V2 in the case where the second potential V2 is different from the reference potential Vref. As a further alternative, a non-ejection waveform w2*b* may be generated using both the second potential V2 and the third potential V3.

In the second exemplary embodiment, whereas the first period T1, the second period T2, the third period T3, and the fourth period T4 have the same length (=Ta), the length of the non-ejection waveform w2*b* is longer than that of the non-ejection waveform w2*a* of the first exemplary embodiment. More specifically, the length of the non-ejection waveform w2*b* is two times the length of the first period T1, that is, equal to 2×Ta.

As described above, the length Ta of the first period T1 is 1/2 times the natural period of pressure waves occurring in the pressure rooms 34 or equal to a pulse width that maximizes the ejection speed or ejection amount of an ink droplet. In the second exemplary embodiment, the length of the non-ejection waveform w2*b* is set longer than that of the non-ejection waveform w2*a* of the first exemplary embodiment, whereby residual vibration that occurs when each piezoelectric element 42 is driven singly using the non-ejection waveform w2*b* is suppressed.

On the other hand, also in the second exemplary embodiment, the difference between the second potential V2 and the reference potential Vref is smaller than the difference between the fourth potential V4 and the reference potential Vref. And the difference between the third potential V3 and the reference potential smaller than the difference between the fourth potential V4 and the reference potential Vref. Thus, also in the second exemplary embodiment, ejection of an ink droplet may occur if the fourth potential V4 in the fourth period T4 is used as a potential of the non-ejection waveform w2*b*. In view of this in the second exemplary embodiment, as described above, the potential of the non-ejection waveform w2*b* is set equal to the third potential V3 which has a relatively small difference from the reference potential Vref. Ejection of an ink droplet due to application of the non-ejection waveform w2*b* is suppressed by setting the potential of the non-ejection waveform w2*b* equal to a potential having a relatively small difference from the reference potential Vref.

As described above, in the second exemplary embodiment, at least one of the second potential V2 in the second period T2 and the third potential V3 in the third period T3 of the ejection waveform w1*b* for image formation is also used to form the non-ejection waveform w2*a* for meniscus vibration control, as a result of which the one-cycle (Tm) length of the drive waveform dw2 is shortened and hence the drive frequency is increased.

[Exemplary Embodiment 3]

Figure 10:
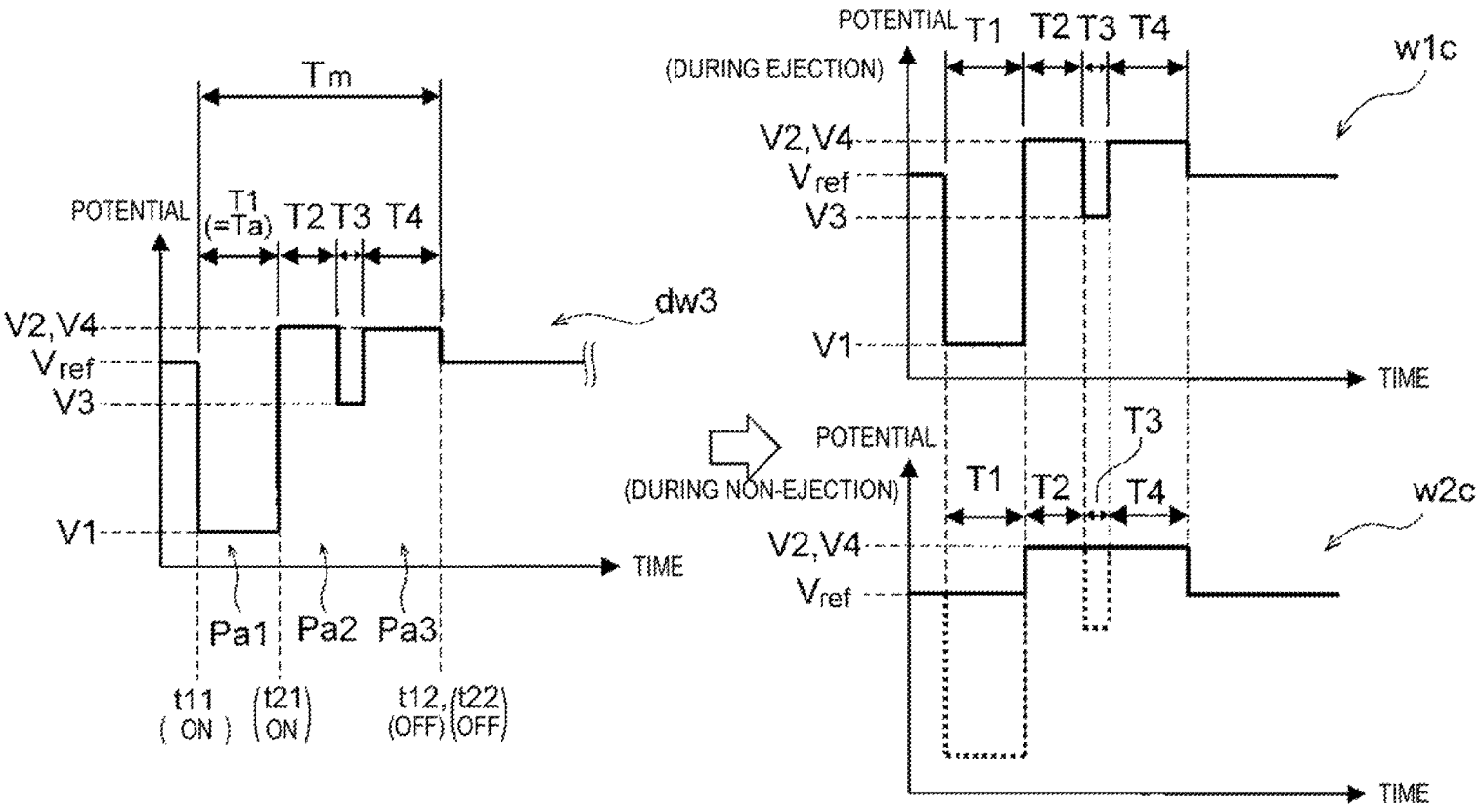
FIG. 10 is waveform diagrams showing an example ejection waveform for image formation and an example non-ejection waveform for meniscus vibration control which are generated by a drive waveform generation device according to a third exemplary embodiment.

FIG. 10 is waveform diagrams showing an example ejection waveform w1*c* for image formation and an example non-ejection waveform w2*c* for meniscus vibration control which are generated by a drive waveform generation device 70 according to a third exemplary embodiment. In FIG. 10, the vertical axis and the horizontal axis represent the potential and time, respectively. The configuration of the drive waveform generation device 70 according to the third exemplary embodiment is basically the same as that according to the first exemplary embodiment, and the common part of the configuration of the former will not be described below.

As shown in the left part of FIG. 10, a drive waveform dw3 is input continuously to the switching elements 22S from the generation unit 50A. One cycle Tm of the drive waveform dw3 includes four periods, that is, a first period T1, a second period T2, a third period T3, and a fourth period T4.

The first period T1 is a period in which the potential of the drive waveform dw3 is at a first potential V1 that is lower than the reference potential Vref. The second period T2 is a period that follows the first period T1 continuously and in which the potential is at a second potential V2 that is higher than the reference potential Vref. The third period T3 is a period that follows the second period T2 continuously and in which the potential is at a third potential V3 that is higher than the first potential and lower than the second potential V2. In this example, the third potential V3 is lower than the reference potential Vref. The fourth period T4 is a period that follows the third period T3 continuously and in which the potential is at a fourth potential V4 that is higher than the reference potential. Vref and lower than or equal to the second potential V2. In this example, the fourth potential V4 is equal to second potential V2. The waveform having the first period T1 to the fourth period T4 is another example of the "fundamental waveform". The drive waveform dw3 is generated in such a manner that the waveform having the first period T1 to the fourth period T4 occurs repeatedly.

As shown in the top-right part of FIG. 10, the generation unit 50A generates an ejection waveform w1*c* (first waveform) for image formation. The ejection waveform w1*c* is a one-cycle (Tm) waveform of the drive waveform dw3 and has the above-mentioned first period T1, second period T2, third period T3, and fourth period T4. That is, the ejection waveform w1*c* is a waveform that is generated using all of the first potential V1 in the first period T1, the second potential V2 in the second period T2, the third potential V3 in the third period T3, and the fourth potential V4 in the fourth period T4.

In the third exemplary embodiment, as in the first exemplary embodiment, the drive waveform dw3 (and the ejection waveform w1*c*) includes three pulses, that is, an ejection pulse Pa1, a control pulse Pa2, and a suppression pulse Pa3.

On the other hand, as shown in the bottom-right part of FIG. 10, the generation unit 50A generates a non-ejection waveform w2*c* (second waveform) for meniscus vibration control. In the third exemplary embodiment, the non-ejection waveform w2*c* is a waveform that has the second period T2 and the third period T3 (which constitute the control pulse Pa2) and the fourth period T4 of the suppression pulse Pa3 and is generated using the second potential V2 in the second period T2 and the fourth potential V4 in the fourth period T4. In this example, the second potential V2 is the same as the fourth potential V4.

Where the second potential V2 and the fourth potential V4 are different from each other, the non-ejection waveform w2*c* may be generated using the second potential V2 or the fourth potential V4.

In the third exemplary embodiment, the first period T1, the second period T2 and the third period T3 combined, and the fourth period T4 have the same length (=Ta). That is, the length of the ejection waveform w1c is equal to 3×Ta, which is shorter than the length (4×Ta) of the ejection waveform w1a of the first exemplary embodiment. Furthermore, the length of the non-ejection waveform w2*c* is two times the length of the first period T1, that is, equal to 2×Ta.

As described above, the length Ta of the first period T1 is 1/2 times the natural period of pressure waves occurring in the pressure rooms 34 or equal to a pulse width that maximizes the ejection speed or ejection amount of an ink droplet. In the third exemplary embodiment, the length of the non-ejection waveform w2*c* is set longer than that of the non-ejection waveform w2*a* of the first exemplary embodiment, whereby residual vibration that occurs when each piezoelectric element 42 is driven singly using the non-ejection waveform w2*c* is suppressed.

On the other hand, in the third exemplary embodiment, the difference between the second potential V2 and the reference potential Vref is smaller than the difference between the first potential V1 and the reference potential Vref. And the difference between the fourth potential V4 and the reference potential Vref is smaller than the difference between the first potential V1 and the reference potential Vref. Thus, in the third exemplary embodiment, ejection of an ink droplet occurs if the first potential V1 in the first period T1 is used as a potential of the non-ejection waveform w2*c*. In view of this, in the third exemplary embodiment, as described above, the potential of the non-ejection waveform w2*c* is set equal to the second potential V2 and the fourth potential V4 which have a relatively small difference from the reference potential Vref. Ejection of an ink droplet due to application of the non-ejection waveform w2*c* is suppressed by setting the potential of the non-ejection waveform w2*c* equal to a potential having a relatively small difference from the reference potential Vref.

As described above, in the third exemplary embodiment, at least one of the second potential V2 the second period T2 and the fourth potential V4 in the fourth period T4 of the ejection waveform w1*c* for image formation are also used to form the non-ejection waveform w2*c* for meniscus vibration control, as a result of which the one-cycle (Tm) length of the drive waveform dw3 is shortened and hence the drive frequency increased.

[Exemplary Embodiment 4]

Figure 11:
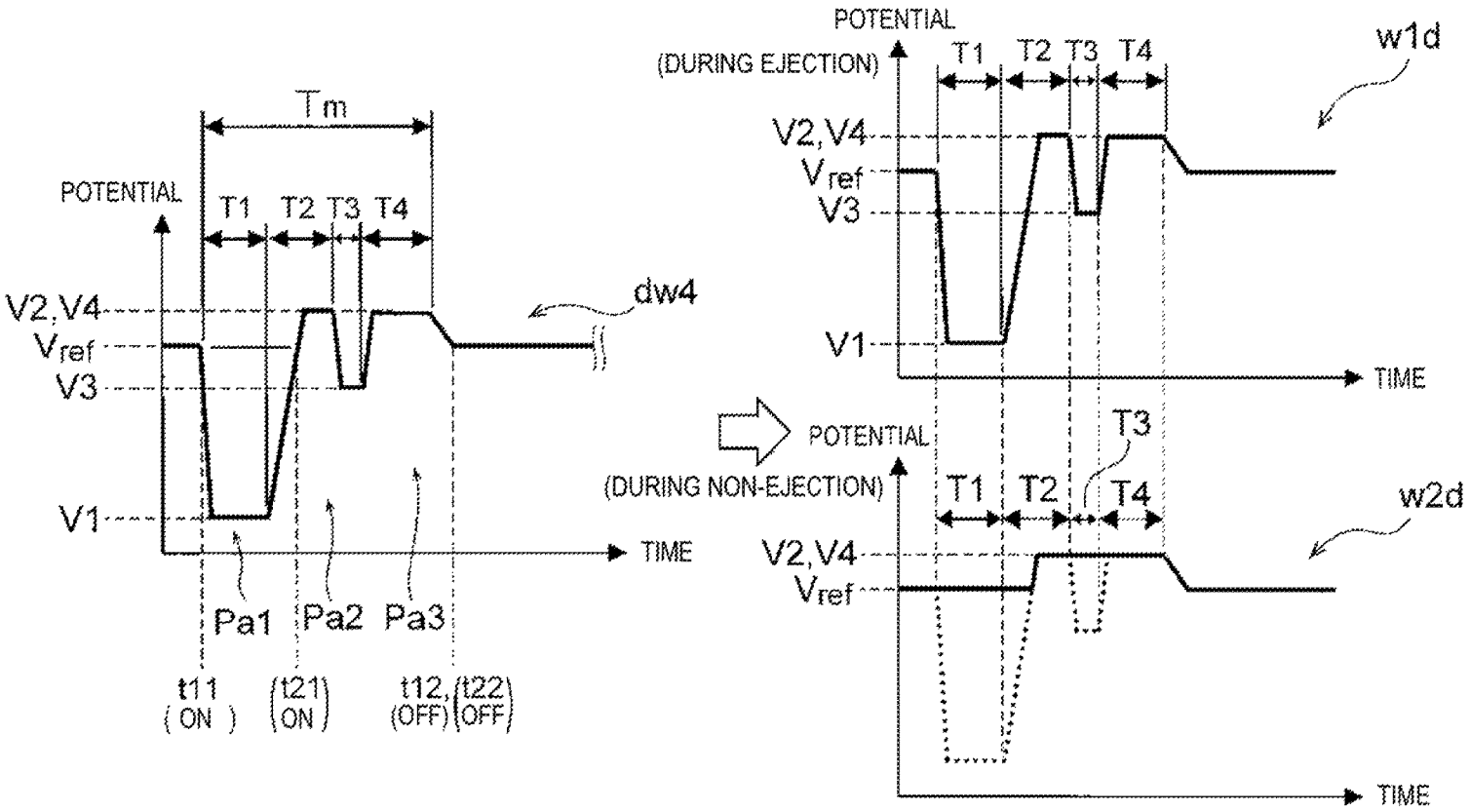
FIG. 11 is waveform diagrams showing an example ejection waveform for image formation and an example non-ejection waveform for meniscus vibration control which are generated by a drive waveform generation device according to a fourth exemplary embodiment.

FIG. 11 is waveform diagrams showing an example ejection waveform w1*d* for image formation and an example non-ejection waveform w2*d* for meniscus vibration control which are generated by a drive waveform generation device 70 according to a fourth exemplary embodiment. In FIG. 11, the vertical axis and the horizontal axis represent the potential and time, respectively. The configuration of the drive waveform generation device 70 according to the fourth exemplary embodiment is basically the same as that according to the first exemplary embodiment, and the common part of the configuration of the former will not be described below.

As shown in the left part of FIG. 11, a drive waveform dw4 is input continuously to the switching elements 22S from the generation unit 50A. In the drive waveform dw4, pulse rising edges and trailing edges are inclined, which prevents occurrence of circuit damage when a large current flows suddenly at the time of switching. One cycle Tm of the drive waveform dw4 includes four periods, that is, a first period T1, a second period T2, a third period T3, and a fourth period T4.

The drive waveform dw4 of the fourth exemplary embodiment will not be described any further because it is the same as the drive waveform dw3 of the third exemplary embodiment except that its pulse rising edges and trailing edges are inclined.

The generation unit 50A generates an ejection waveform w1d (first waveform) for image formation in a manner shown in the top-right part of FIG. 11, and generates a non-ejection waveform w2*d* (second waveform) for meniscus vibration control in a manner shown in the bottom-right part of FIG. 11.

The drive waveform generation devices and the image forming apparatus according to the exemplary embodiments have been described above. Each exemplary embodiment may be implemented in the form of a program for causing a computer to perform the functions of the respective units of the drive waveform generation device or a computer-readable storage medium that is stored with such a program.

The configurations of the drive waveform generation devices and the image forming apparatus according to the exemplary embodiments are just examples, and can be modified as appropriate without departing from the spirit and scope of the invention.

The processes of the programs employed in the exemplary embodiments are also just examples. Unnecessary steps may be deleted, new steps may be added, and the execution order of steps may be reversed without departing from the spirit and scope of the invention.

Although in each of the exemplary embodiments the process is executed in software form using a computer, the invention is not limited to this case. In each exemplary embodiment, the process may be implemented by, for example, a hardware configuration or a combination of a hardware configuration and a software configuration.

What is claimed is:

1. A drive waveform generation device comprising a generation unit that generates a drive waveform having, as each cycle, a first waveform for droplet ejection or a second waveform for vibrating a liquid meniscus by selecting from a first period having a first potential that is lower than a reference potential, a second period that follows the first period continuously and has a second potential that is higher than or equal to the reference potential, a third period that follows the second period continuously and has a third potential that is higher than the first potential and lower than the second potential, and a fourth period that follows the third period continuously and has a fourth potential that is higher than the first potential and lower than the third potential, the first period, the second period, the third period and the fourth period being included in a fundamental waveform, wherein the generation unit generates the first waveform using the first potential, the second potential, the third potential and the fourth potential of the fundamental waveform and generates the second waveform using at least one of the second potential and the third potential of the fundamental waveform.

2. The drive waveform generation device according to claim 1, wherein the first period, the second period, the third period and the fourth period are same in length.

3. The drive waveform generation device according to claim 2, wherein:

the drive waveform is applied to drive elements each of which ejects a droplet from a nozzle connected to a pressure room when pressure waves are generated by the drive waveform in a liquid existing in the pressure room; and the length of the first period is 1/2 times the length of a natural period of the pressure waves.

4. The drive waveform generation device according to claim 3, wherein:

the first period corresponds to a pulse width of ejection pulse that is formed by the first potential and serves for ejection of the droplet;

the second period and the third period combined correspond to a pulse width of a control pulse that is formed by the second potential and the third potential and serves to control a tail portion of the droplet being ejected; and the fourth period corresponds to a pulse width of a suppression pulse that is formed by the fourth potential and serves to suppress residual vibration that is caused by the pressure waves occurring in the pressure room after ejection of the droplet.

5. The drive waveform generation device according to claim 3, wherein the length of the second waveform is two times the length of the first period.

6. The drive waveform generation device according to claim 3, wherein:

the difference between the second potential and the reference potential is smaller than the difference between the fourth potential and the reference potential; and the difference between the third potential and the reference potential is smaller than the difference between the fourth potential and the reference potential.

7. The drive waveform generation device according to claim 2, wherein:

the drive waveform is applied to drive elements each of which ejects a droplet from a nozzle connected to a pressure room when pressure waves are generated by the drive waveform in a liquid existing in the pressure room; and the length of the first period is equal to a pulse width that maximizes an ejection speed or an ejection amount of the droplet.

8. The drive waveform generation device according to claim 7, wherein:

the first period corresponds to a pulse width of an ejection pulse that is formed by the first potential and serves for ejection of the droplet;

the second period and the third period combined correspond to a pulse width of a control pulse that is formed by the second potential and the third potential and serves to control a tail portion of the droplet being ejected; and the fourth period corresponds to a pulse width of suppression pulse that is formed by the fourth potential and serves to suppress residual vibration that is caused by the pressure waves occurring in the pressure room after ejection of the droplet.

9. The drive waveform generation device according to claim 7, wherein the length of the second waveform is two times the length of the first period.

10. The drive waveform generation device according to claim 7, wherein:

the difference between the second potential and the reference potential is smaller than the difference between the fourth potential and the reference potential; and the difference between the third potential and the reference potential is smaller than the difference between the fourth potential and the reference potential.

11. The drive waveform generation device according to claim 2, wherein the length of the second waveform is two times the length of the first period.

12. The drive waveform generation device according to claim 2, wherein:

the difference between the second potential and the reference potential is smaller than the difference between the fourth potential and the reference potential; and the difference between the third potential and the reference potential is smaller than the difference between the fourth potential and the reference potential.

13. The drive waveform generation device according to claim 1, wherein:

the difference between the second potential and the reference potential is smaller than the difference between the fourth potential and the reference potential; and the difference between the third potential and the reference potential is smaller than the difference between the fourth potential and the reference potential.

14. An image forming apparatus comprising:

a plurality of drive elements each of which ejects a droplet from a nozzle connected to a pressure room when pressure waves are generated in a liquid existing in the pressure room; and the drive waveform generation device according to claim 1, wherein the image forming apparatus forms an image on a recording medium by ejecting droplets by applying the drive waveform generated by applying the drive waveform generation device to each of the plurality of drive elements.

15. A drive waveform generation device comprising a generation unit that generates a drive waveform having, as each cycle, a first waveform for droplet ejection or a second waveform for vibrating a liquid meniscus by selecting from a first period having a first potential that is lower than a reference potential, a second period that follows the first period continuously and has a second potential that is higher than the reference potential, a third period that follows the second period continuously and has a third potential that is higher than the first potential and lower than the second potential, and a fourth period that follows the third period continuously and has a fourth potential that is higher than the reference potential and lower than or equal to the second potential, the first period, the second period, the third period, and the fourth period being included in a fundamental waveform, wherein the generation unit generates the first waveform using the first potential, the second potential, the third potential, and the fourth potential of the fundamental waveform and generates the second waveform using at least one of the second potential and the fourth potential of the fundamental waveform.

16. The drive waveform generation device according to claim 15, wherein the first period, the second period and the third period combined, and the fourth period are the same in length.

17. The drive waveform generation device according to claim 16, wherein:

the difference between the second potential and the reference potential is smaller than the difference between the first potential and the reference potential; and the difference between the fourth potential and the reference potential is smaller than the difference between the first potential and the reference potential.

18. The drive waveform generation device according to claim 15, wherein:

the difference between the second potential and the reference potential is smaller than the difference between the first potential and the reference potential; and the difference between the fourth potential and the reference potential is smaller than the difference between the first potential and the reference potential.

* * * * *